US005178381A

United States Patent [19]

Nash et al.

[11] Patent Number: 5,178,381

[45] Date of Patent: Jan. 12, 1993

[54] PROCESSING FLEXIBLE SHEET WORKPIECES

[75] Inventors: Michael A. Nash, Aldermans Green; Bashir Laheria, Coventry, both of United Kingdom

[73] Assignees: Courtaulds PLC, London; Cegelec Projects Limited, Warwickshire, both of England

[21] Appl. No.: 671,820

[22] PCT Filed: Oct. 3, 1989

[86] PCT No.: PCT/GB89/01169

§ 371 Date: Apr. 19, 1991

§ 102(e) Date: Apr. 19, 1991

[87] PCT Pub. No.: WO90/03739

PCT Pub. Date: Apr. 19, 1990

[30] Foreign Application Priority Data

Oct. 4, 1988 [GB] United Kingdom ..... 8823266

[51] Int. Cl.[5] ..... B65H 5/00

[52] U.S. Cl. ..... 271/264; 271/1; 112/121.15; 112/262.3; 414/14; 414/222; 901/8

[58] Field of Search ..... 112/104, 121.12, 121.15, 112/262.3; 271/1, 264, 266; 414/222, 14; 901/6, 8

[56] References Cited

U.S. PATENT DOCUMENTS

| | | | |
|---|---|---|---|
| 3,620,525 | 11/1971 | Hawley | 270/61 R |
| 3,752,471 | 8/1973 | Hawley | 271/4 |
| 4,498,404 | 2/1985 | Sadeh | 112/121.12 |
| 4,512,269 | 4/1985 | Bowditch | 112/121.12 |
| 4,539,924 | 9/1985 | Bell, Jr. et al. | 112/121.15 X |
| 4,588,343 | 5/1986 | Garrett | 414/222 X |
| 4,608,936 | 9/1986 | Ball et al. | 112/121.12 |
| 4,611,749 | 9/1986 | Kawano | 901/8 X |
| 4,649,838 | 3/1987 | Gazzarrini | 112/121.15 |
| 4,673,075 | 6/1987 | Ueyama et al. | 901/6 X |
| 4,756,261 | 7/1988 | Gershoni | 112/121.12 X |
| 4,953,687 | 9/1990 | Gazzarrini | 112/121.15 X |
| 5,003,897 | 4/1991 | Yokoe et al. | 112/121.12 |
| 5,018,462 | 5/1991 | Brocklehurst | 112/121.12 |

OTHER PUBLICATIONS

Manufacturing Clothier, vol. 29, No. 5, p. 820, "Transportation Systems in Clothing Production", (Nov. 1960).

*Primary Examiner*—Robert P. Olszewski
*Assistant Examiner*—Boris Milef
*Attorney, Agent, or Firm*—Davis Hoxie Faithfull & Hapgood

[57] ABSTRACT

An apparatus for processing a flexible sheet workpiece is disclosed. The apparatus includes workstations arranged in at least two parallel series. Each workstation is adapted to carry out at least one operation on the workpiece, which can then be transferred to the next workstation in the series or, if desired, from a workstation in one series to a workstation in an adjacent series across an interchange area between the two series.

6 Claims, 2 Drawing Sheets

PROCESSING FLEXIBLE SHEET WORKPIECES

TECHNICAL FIELD

This invention relates to a method and apparatus for processing flexible sheet workpieces, such as fabric workpieces, through at least part of a procedure for making up workpieces into garments or other products made from flexible sheet material.

BACKGROUND ART

Apparatus is known for carrying out specific operations in a garment assembly process, examples being automated sewing machines and apparatus for automatically removing a fabric play from a stack of fabric plies. Little has been done, however, to develop a system wherein the transfer of fabric pieces between workstations is automatic. Current garment assembly systems, therefore, remain labour intensive. Where more automated systems have been introduced, they are usually specific to the manufacture of one type of garment or garment piece.

DISCLOSURE OF THE INVENTION

The present invention provides an automated system whilst allowing a degree of versatility and adjustability to be achieved such that the range of operations which can be carried out by a single apparatus is enlarged and thus adaptation to size, fashion and style changes in the assembly of garments and other products is facilitated. The invention consists of apparatus for processing a flexible sheet workpiece which comprises:

(a) two or more workstations, each workstation being adapted to carry out at least one operation on the flexible sheets workpiece;

(b) a bypass area adjacent to one or more of the workstations, the bypass area being adapted such that the workpiece can be transferred from a workstation to the bypass area in order to bypass a subsequent workstation; and (c) one or more transfer means capable of transferring the workpiece form one workstation to another workstation, from a workstation to the bypass area and from a bypass area to the workstation.

The provision of a bypass area enables the workpiece to be either automatically processed through each of the workstations in the apparatus or to bypass automatically one or more workstations if the operations carried out at that particular workstation is not required for that particular workpiece. Without the bypass area, either the workpiece has to be manually removed from the assembly line and repositioned further along the line, or the apparatus itself must be modified by removing or replacing one or more workstations in order to produce different garment types or other end products. Thus by using transfer means to move workpieces automatically from one workstation to another, and to and from the bypass area when required, a system is provided which is both a automated and flexible.

Although the workstations and bypass area can be arranged in any suitable manner, it is preferred that they are in a substantially linear arrangement with the bypass area positioned adjacent to and extending along substantially the length of the arrangement of workstations.

For even greater flexibility, a preferred embodiment of the invention provides apparatus for processing a flexible sheet workpiece which comprises:

(a) two or more series of workstations, each workstation being adapted to carry out at least one operation on the flexible sheet workpiece, and each series being substantially parallel to adjacent series;

(b) an interchange area between each adjacent series of workstations, each interchange area being adapted such that the workpiece can be transferred from a workstation in one series to a workstation in an adjacent series via the interchange area; and (c) transfer means capable of transferring the workpiece from one workstation to another workstation, from a workstation to an interchange area and from an interchange area to a workstation.

In addition to being used to transfer the workpiece from one series of workstations to another, the interchange area can also be used as a bypass area as described above and hereinafter shall be referred to as the interchange/bypass area. Thus as it is processed along the assembly line, the workpiece can transferred by means of transfer means from one workstation to another in the same series, from one workstation in one series across the bypass/interchange area to another workstation in another series and/or from one workstation to the bypass/interchange area and then moved along the bypass/interchange area in order to bypass one or more workstations, after which it is transferred either back to another workstation in the same series or across to another workstation in another series.

The provision of two or more series of workstations operating in parallel and with an intermediate bypass-/interchange area enables two or more component parts of an end-product to be processed separately and simultaneously, and then one part transferred across to the other for joining together. This is especially advantageous for the production of a garment from two or more component pieces where it is necessary, for example, to bind an edge of each component piece before sewing them together.

The operations carried out at the workstations may be, for example, sewing, bonding, stacking, unstacking, or "manipulating" by which is meant an operation such as folding, unfolding, turning over, or rotating in the plane of the worksurface. Although the workstations may be arranged in any desired order, it is usual for a manipulator to precede a sewing station so that the workpiece can be manoeuvred to its desired position ready for sewing. It has been found that the system works efficiently if the manipulator workstations are positioned in the system in the overlap region of two or more robotic devices so that one robotic device can transport the workpiece to the manipulator and another robotic device can transport the workpiece away from the manipulator after the workpiece has been manipulated. This constitutes another aspect of the present invention.

The transfer means employed in the apparatus of the invention are preferably robotic devices, by which is meant a programmable multi-functional manipulator designed to move material or parts through variable programmed motions for the performance of a variety of tasks. Advantageously the robotic devices comprises a system of robots designed so that the working envelope of each robot includes at least one workstation and at least a portion of the bypass/interchange area adjacent to that workstation, and so that the working envelope of one robot overlaps with the working envelope of adjacent robots thus enabling the robots to transfer the workpiece to each other along the assembly line.

Where necessary, the robot preferably also guides the workpiece through the workstation. For example, where the workstation is a sewing machine the robot preferably guides the fabric workpiece through the sewing head as well as moving the workpieces to and from the workstation and on to the next stage in the process. Although a separate transfer mechanism can be used for moving the workpiece along the interchange/-bypass area, it is beneficial that the working envelopes of the robots are extended so that they can also move the fabric along the interchange/bypass area by transferring the workpiece from one robot to another along the area.

The workpieces are preferably transferred by the transfer means from one workstation to another by sliding them across a flat surface. To facilitate this, each workstation is preferably supported on, or surrounded by, a low friction, flat surface such as a metal table. The interchange/bypass area is preferably also a flat surface and is contiguous or integral with the workstation or workstations to which it is adjacent.

The apparatus according to the invention may comprise a number of workstations in a permanently fixed position or may comprise a number of workstations or modules which are interchangeable. Each module, which may include one or more workstations, is preferably of a standard size and shape so that any module can be removed from the assembly area, e.g. assembly line, and replaced by any other without disturbing the position of the remaining modules in the assembly area. Provision may be made for the modules to be secured to one another and the modules are preferably designed such that when located in an assembly line each has a flat surface contiguous with flat surfaces of adjacent modules and the bypass/interchange area to facilitate transfer of a workpiece along the assembly line by sliding over the flat surfaces. The term assembly line means any assembly arrangement enabling the workpiece to be processed sequentially at a series of workstations and embraces such workstations when arranged in a straight line or lines and workstations when arranged circumferentially around a central bypass/interchange area.

The workpiece of flexible sheet material to be operated on may comprises one or more pieces of flexible sheet material and the term "workpiece" is therefore to be interpreted, where appropriate, as comprising two or more pieces of flexible sheet material, not necessarily joined together. An operation to be carried out on a workpiece at a workstation in apparatus according to the invention may comprise, for example, joining two pieces of flexible sheet material together, for example by sewing, or it may comprise operating on only one piece of material, for example, to sew and bind an edge. Alternatively it may comprise manipulating the flexible sheet material to prepare, for example, for a subsequent sewing operation. Folding, unfolding, turning over or rotating (i.e. through a given angle less than 360°) the material are typical of manipulating operations.

At the beginning of the assembly line the workpieces ready for processing are usually stacked together. The workpieces may be separated and fed into the assembly line manually, but preferably this is carried out automatically using, for example, a ply separator-feeder machine, thereby giving a more fully automated system. Similarly, after being processed through the assembly line the assembled workpieces are usually stacked ready for packing or further processing, and this may also be carried out manually or using an automatic stacking machine.

The present invention is applicable to the making-up of flexible sheet material such as sheets of synthetic plastics material or sheets of non-woven material as well as knitted or woven fabrics. In applying the invention to workpieces of suitable thermoplastic materials, a joining operation such as welding may be carried out at one or more workstations.

BRIEF DESCRIPTION OF THE DRAWINGS

Specific embodiments of the invention will now be described, by way of example only, with reference to the accompanying drawings in which.

BEST MODE OF CARRYING OUT THE INVENTION

Figure 1:
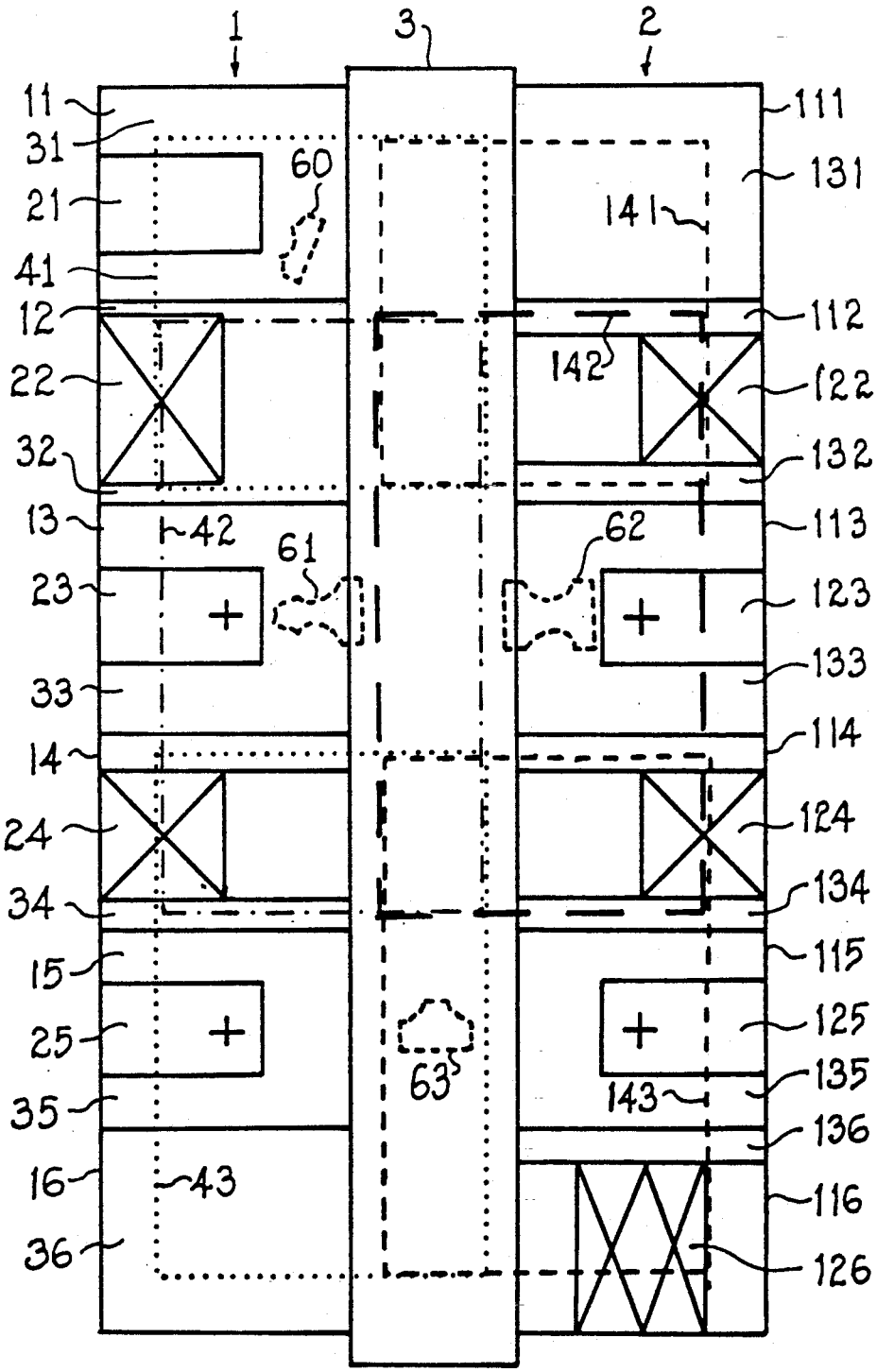
FIG. 1 is a diagrammatic plan of a garment assembly line.

Referring to the drawings, the assembly line comprises two linear series 1, 2 of interchangeable modular workstations with a bypass/interchange area 3 between and contiguous with the two series.

In the first series of workstations 1, the first module 11, third module 13 and fifth module 15 are each automatic sewing machines 21, 23, 25 mounted on flat, low-friction stainless steel support surfaces 31, 33, 35. The second module 12 comprises a ply-separator feeder machine 22 mounted on a flat, low friction stainless steel support surface 32. The fourth module 14 is a manipulator machine 24 mounted on flat, low-friction support surface 34. The sixth module is a supported table top with a low-friction stainless steel surface 36.

In a second series of workstations 2, the first module 111 is a table top with a low-friction stainless steel surface 131. The second module 112 and fourth module 114 are each manipulator machines 122, 124 mounted on flat, low-friction stainless steel support surfaces 132, 134. The third module 113 and fifth module 115 are each sewing machines 123, 125 mounted on flat, low-friction stainless steel support surfaces 133, 135. The sixth module 116 is a stacking machine 126 mounted on a flat low-friction stainless steel support surface 136.

Typically the manipulator machines, 24, 122 and 124 each comprises a fixed perforated support surface and a similarly sized movable perforated support surface (designated by a cross in the figures) hinged thereto for movement through approximately 180° between a closed position (in which the movable perforated support surface is positioned immediately over the fixed perforated support surface) and an open position (in which the movable perforated support surface is positioned adjacent the fixed perforated support surface and in substantially the same plane thereof). Suction can be applied beneath each of the support surfaces for positively holding workpieces in position or the support surfaces. By controlling the application of the suction and the movement of the movable perforated support surface, a full range of manipulator operations can be achieved including: "turning" (by moving the movable support surface between its open and closed positions to transfer the workpiece from one to the other of the support surfaces), "laying" one workpiece positioned on the movable support surface on top of another workpiece positioned on the fixed support surface and "folding" (by positioning a workpiece over the hinge when the movable support surface is in its open position and then moving the moving support into the closed position).

Flexible workpieces are moved about the assembly line of FIG. 1 by means of overhead gantry robotic devices. The working envelopes of six robotic devices are shown by dotted lines 41 and 43 and chain line 42 in the first series of workstations 1 and by short dashed lines 141 and 143 and long dashed lines 142 in the second series and workstations 2. In FIG. 1 shaped end effectors 60–63 of the various robotic devices are shown in dashed lines. The peripheries of the end effectors are shaped to conform to shape of the workpiece they are intended to operate on and, in use, press the workpiece onto the support surface and, under robotic control, move the workpiece as required. Only four end effectors are shown in FIG. 1, since it is possible to use a single robotic device for the working envelopes 41 and 141 and another single robotic device for the working envelopes 43 and 143. However if six robotic devices are employed two further end effectors (not shown) corresponding to end effectors 60 and 63 are required. It can be seen that the manipulators 24, 122 and 124 each lie in the overlap regions between the working envelopes of two robotic devices. With the is robotic devices the working envelope of each robotic device extends into the bypass/interchange area 3 and overlaps with the working envelopes of neighbouring robotic devices so that, flexible workpieces may be transferred from one robotic device to another in the bypass/interchange area.

Although any suitable pieces of equipment may be used, the ply-separator feeder 22 is preferably as described in International Patent Publication No. WO90/03936; the manipulators 24, 122 and 124 are preferably as described in International Patent Publication No. WO90/039490. The robotic devices are preferably as described in International Patent Publication No. WO90/03740.

Figure 2:
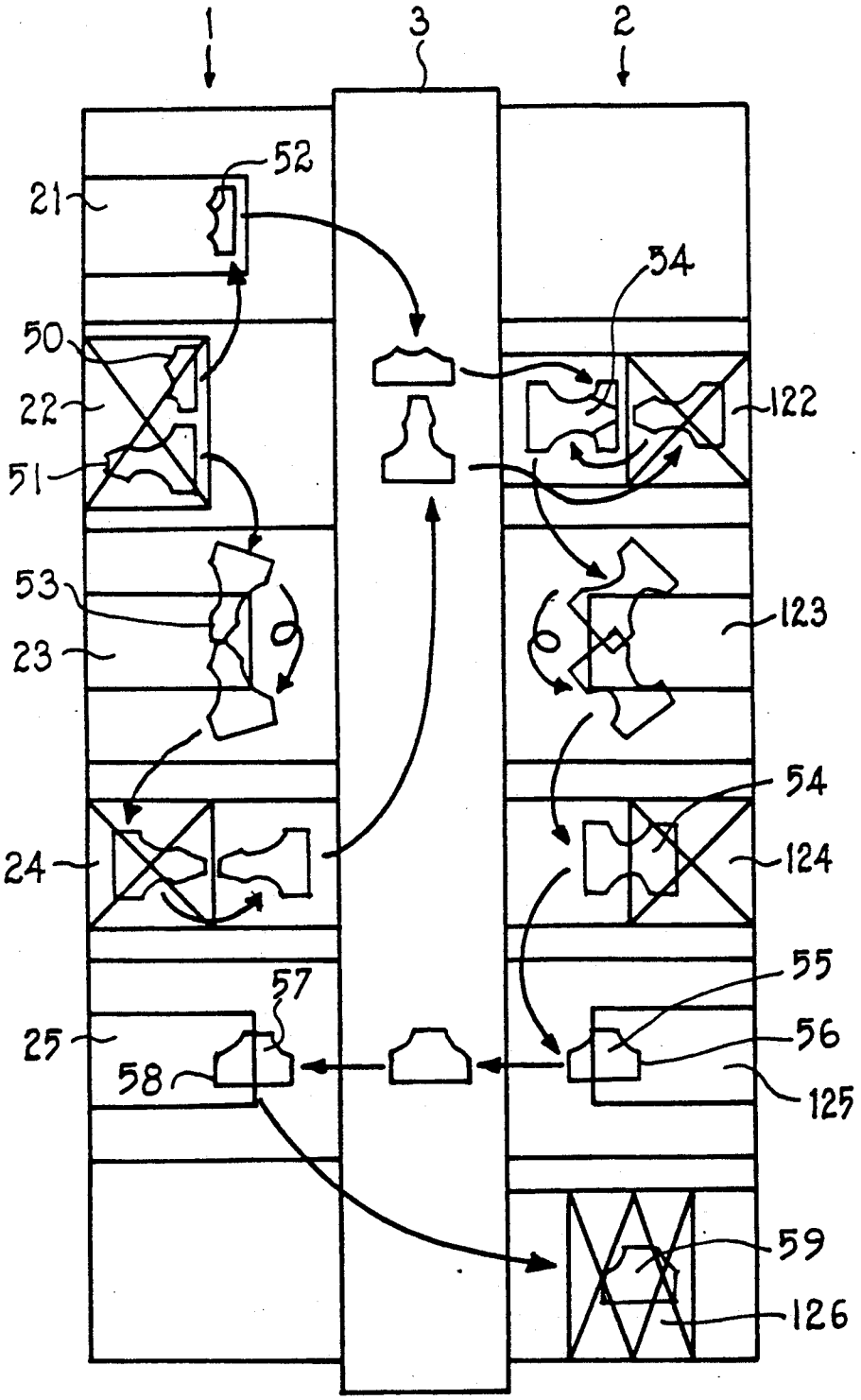
FIG. 2 shows the stages in processing garment pieces into an assembled garment using the assembly line of FIG. 1.

One operation of the assembly line shown in FIG. 1 in shown diagrammatically in FIG. 2. Two stacks of garment pieces 50 and 51 are placed in predetermined positions in the ply separator-feeder 22. The ply separator-feeder then operates to lift the top piece from the stack of garment pieces 50 (a front piece for a pair of men's underpants) and this piece is then slid across the flat surface by a preprogrammed robotic device (not shown) and is presented to the sewing machine 21 for attachment of a binding (not shown) to the edge 52 of front piece 50. The general direction of movement of the garment pieces about the assembly line is indicated by the arrows in FIG. 2. The front piece 50 is then slid by the same robotic device from the sewing machine 21 into the bypass/interchange area 3.

At approximately the same time as the front piece 50 is lifted and moved to sewing machine 21, the ply separator-feeder 22 operates to lift the top piece from the stack of garment pieces 51 (a combined back and gusset piece for a pair of men's underpants, hereinafter referred to as the "back piece") and this back piece 51 is slid by means of a programmed robotic device from the ply separator-feeder 22 and is presented to the sewing machine 23 for attachment of a binding to the gusset edge 53 of the back piece 51. The back piece 51 is then slid by means of a robotic device form the sewing machine 23 to a predetermined position on the manipulator 24. The manipulator 24 operates to turn over the back piece 51, and the back piece 51 is then slid by a robotic device into the bypass/interchange area 3 and positioned behind the front piece 50.

The two pieces 50, 51 are slid simultaneously and by the same robot device from the bypass/interchange area 3 to predetermined positions on the manipulator 122 in the second series of workstations 2. The manipulator 122 operates to turn back over the back piece 51 so that it overlies the front piece 50. The two garment pieces 50, 51 are now combined into the shape of an opened out pair of men's underpant 54. The piece 54 is slid by a robot device from the manipulator and presented to the sewing machine 123 where the two pieces 50 and 51 are sewn together. A robotic device then slides the piece 54 from the sewing machine 123 to the manipulator 124 where the piece 54 is folded in half along the gusset resulting in folded garment piece 55. Piece 55 is then slid from the manipulator 124 by a robotic device and presented to the sewing machine 124 whereupon the two edges 56 are each sewn together, starting at the waistband edge and finishing at the leg opening, to produce a garment piece 57.

The garment piece 57 is then slid by a robotic device from sewing machine 125 to be presented to sewing machine 25 whereupon the two edges 58 are sewn together starting at the waistband edge and finishing at the leg opening. The almost complete underpants 59 (they require a waistband to be sewn in) is then slid by a robotic device from sewing machine 25 to the stacker 126.

We claim:

1. Apparatus for processing a flexible sheet workpiece comprising workstations arranged in at least two parallel series of workstations and each adapted to carry out at least one operation on the flexible sheet workpiece, transfer means capable of transferring the workpiece from one workstation to another workstation, and an interchange area between and contiguous with each adjacent series of workstations, the transfer means and interchange area being arranged so that the transfer means can transfer the workpiece from a workstation to an interchange area, from an interchange area to a workstation and across the interchange area from a workstation in one series to a workstation in an adjacent series.

2. Apparatus according to claim 1, in which each interchange area is also a bypass area adapted such that the workpiece can be transferred from a workstation to the bypass workpiece acan be transferred from a workstation to the bypass area in order to bypass a subsequent workstation.

3. Apparatus according to claim 1, in which the transfer means comprise robotic devices.

4. Apparatus according to claim 3, in which the robotic devices are arranged in a system such that the working envelope of each robotic device overlaps with the working envelope of at least one adjacent robotic device, thereby enabling the workpiece to be transferred from one robotic device to another.

5. Apparatus according to claim 3, in which at least one of the robotic devices can be programmed to guide the workpiece through at least one workstation as well as to transfer the workpiece.

6. Apparatus according to claim 1, in which the interchange area comprises a flat, low friction surface and each workstation comprises a flat, low friction surface so that the workpiece can be transferred to and from the workstations and to and from the interchange area by the transfer means by sliding across flat, low friction surfaces.

* * * * *

UNITED STATES PATENT AND TRADEMARK OFFICE

CERTIFICATE OF CORRECTION

PATENT NO. : 5,178,381
DATED : January 12, 1993
INVENTOR(S) : Nash, et. al.

It is certified that error appears in the above-indentified patent and that said Letters Patent is hereby corrected as shown below:

Col. 1, line 15, change "play" to --ply--.

Col. 1, line 35, change "sheets" to --sheet--.

Col. 1, line 60, after "both", delete "a".

Col. 2, line 19, after "can", insert --be--.

Col. 2, line 61, change "comprises" to --comprise--.

Col. 3, line 44, change "comprises" to --comprise--.

Col. 4, line 48, change "comprises" to --comprise--.

Col. 5, line 11, change "and" to --of--.

Col. 5, line 26, change "is" to --six--.

Col. 5, line 38, change "WO90/039490" to --WO90/03940--.

Col. 5, line 41, change "in" (second occurrence) to --is--.

Col. 5, line 66, change "form" to --from--.

Col. 6, line 10, change "underpant" to --underpants--.

Col. 6, line 18, change "124" to --125--.

UNITED STATES PATENT AND TRADEMARK OFFICE

CERTIFICATE OF CORRECTION

PATENT NO. : 5,178,381

DATED : January 12, 1993

INVENTOR(S) : Nash, et. al.

It is certified that error appears in the above-indentified patent and that said Letters Patent is hereby corrected as shown below:

Col. 6, lines 47, 48, (Claim 2) delete "workpiece acan be transferred from a workstation to the bypass".

Signed and Sealed this

Twenty-first Day of December, 1993

*Attest:*

Bruce Lehman

BRUCE LEHMAN

*Attesting Officer*

*Commissioner of Patents and Trademarks*